US008884724B2

(12) United States Patent
Wong

(10) Patent No.: US 8,884,724 B2
(45) Date of Patent: Nov. 11, 2014

(54) CAVITY FILTER WITH TUNING STRUCTURE

(75) Inventor: Kwo-Jyr Wong, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 317 days.

(21) Appl. No.: 13/410,294

(22) Filed: Mar. 2, 2012

(65) Prior Publication Data

US 2013/0181790 A1 Jul. 18, 2013

(30) Foreign Application Priority Data

Jan. 12, 2012 (CN) ..... 2012 1 0008174

(51) Int. Cl.
*H01P 1/205* (2006.01)
*H01P 7/04* (2006.01)

(52) U.S. Cl.
CPC ..... *H01P 1/2053* (2013.01); *H01P 7/04* (2013.01)
USPC ..... 333/202; 333/203; 333/223; 333/235

(58) Field of Classification Search
CPC ..... H01P 7/06; H01P 7/04; H01P 1/2053
USPC ..... 333/17.1, 203, 224, 231–233, 235, 202, 333/206, 207, 208, 209, 227, 219
See application file for complete search history.

(56) References Cited

U.S. PATENT DOCUMENTS 6,642,815 B2 * 11/2003 Okazaki et al. ..... 333/202
7,449,981 B2 * 11/2008 Park et al. ..... 333/203
8,686,810 B2 4/2014 Park et al.
2009/0002100 A1 * 1/2009 Juri ..... 333/203
2009/0058563 A1 * 3/2009 Seo et al. ..... 333/209

FOREIGN PATENT DOCUMENTS

CN 201562744 U 8/2010
CN 101946363 A 1/2011
WO 2010133049 A1 11/2010

OTHER PUBLICATIONS

Merriam Webster Definition : www.marriam-webster.com/dictionary : Access on Mar. 12, 2014.*

* cited by examiner

*Primary Examiner* — Benny Lee
*Assistant Examiner* — Jorge Salazar, Jr.
(74) *Attorney, Agent, or Firm* — Novak Druce Connolly Bove + Quigg LLP

(57) ABSTRACT

A cavity filter includes a housing having a positioning portion, a cover on top of the housing which have a pair of first positioning holes, a sliding plate with movably support on the positioning portion and mounted between the positioning portion and the cover to be configured to adjust a resonating frequency of the cavity filter, and a tuning structure fixed on the cover and having a pair of first positioning poles. The sliding plate includes a plurality of elastic arms, each of which is made of insulated material and supported by the positioning portion. Each of the pair of first positioning poles extends through the corresponding first positioning holes to touch the corresponding one of the plurality of elastic arms of the sliding plate.

20 Claims, 9 Drawing Sheets

CAVITY FILTER WITH TUNING STRUCTURE

The present application claims priority to Foreign Patent Application CN2012100008174.3 filed on Jan. 12, 2012.

BACKGROUND

1. Technical Field

The present disclosure relates to cavity filters, and more particularly to a cavity filter with a tuning structure.

2. Description of Related Art

A cavity filter is a common feature in a mobile communication system, and comprises a housing, a cover covering on the housing, and a sliding plate. The housing comprises a positioning portion on a sidewall thereof. A plurality of resonators are fixed in the housing. The sliding plate is movably positioned on the positioning portion and between the cover and the plurality of resonators. The sliding plate comprises a plurality of adjusting units plated with a metal layer. A gap portion is defined between the sliding plate and the cover to avoid electric spark which is produced by the sliding plate touching with the cover. The sliding plate moves on the positioning portion to adjust a relative position between the plurality of adjusting units and the plurality of resonators and to adjust a resonating frequency of the cavity filter.

When the sliding plate moves to adjust the resonating frequency of the cavity filter, the sliding plate is prone to jump between the positioning portion and the cover due to the gap portion. That is, the sliding plate cannot be exactly positioned between the positioning portion and the cover. Therefore, it is difficult to accurately adjust the resonating frequency of the cavity filter.

Therefore, a need exists in the industry to overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
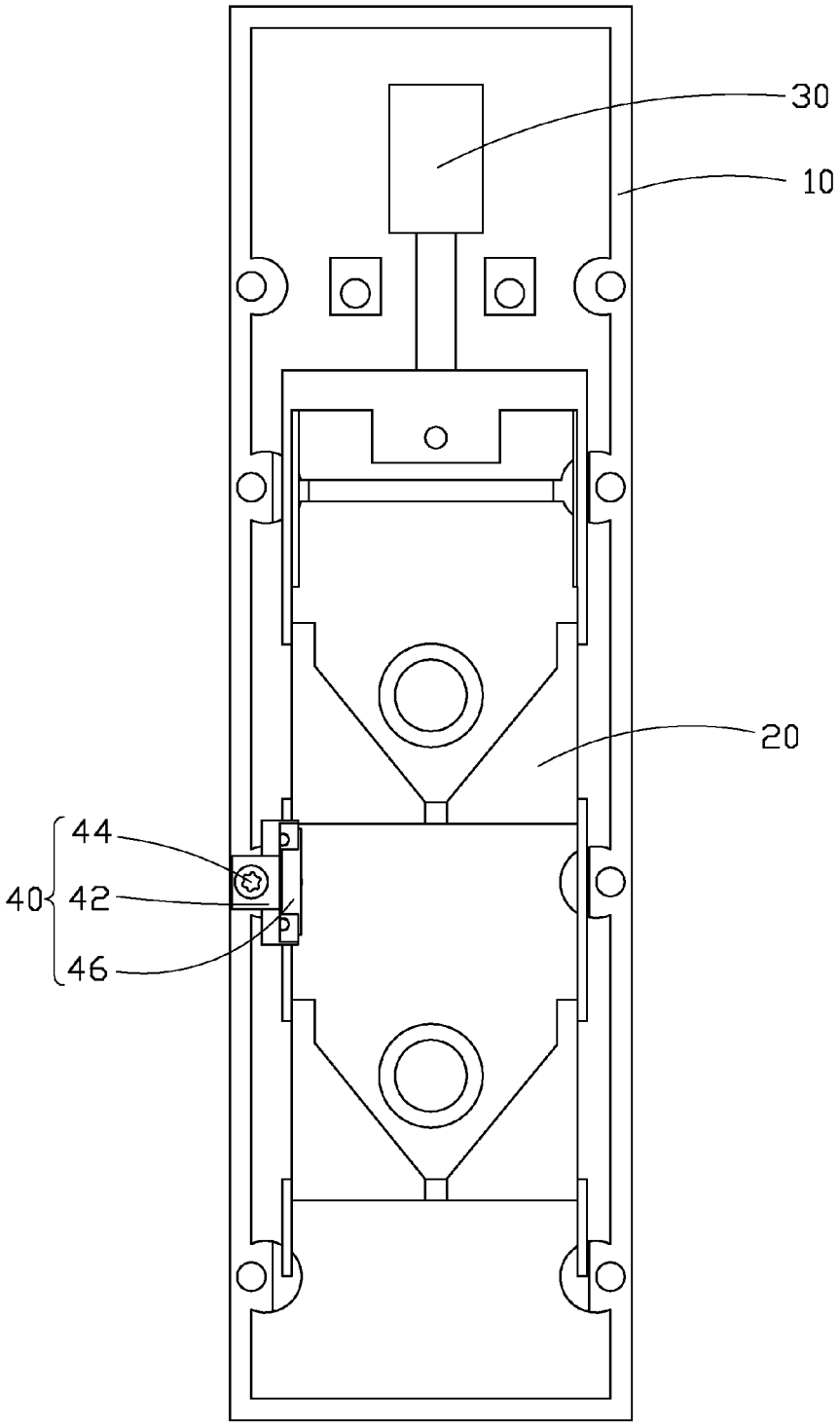
FIG. 1 is a schematic diagram of a cavity filter without a cover in accordance with a first exemplary embodiment of the disclosure.
Figure 2:
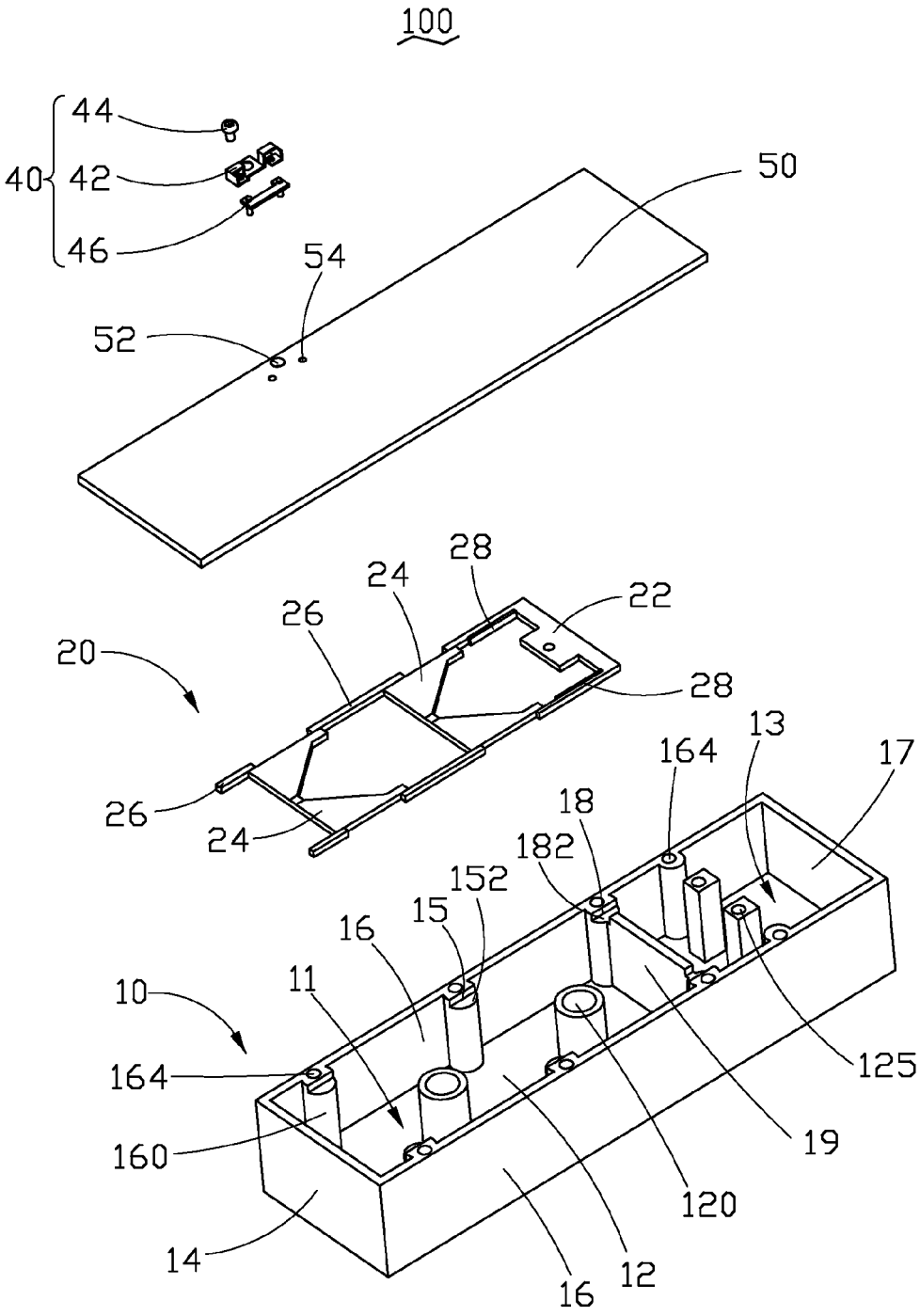
FIG. 2 is a disassembled perspective view of the cavity filter without a driving device in accordance with the first exemplary embodiment of the disclosure.

Please referring to FIG. 1 and FIG. 2, a cavity filter 100 comprises a housing 10, a sliding plate 20, and a cover 50. The cover 50 is securely mounted on the housing 10, and the sliding plate 20 is mounted in the housing 10 and close to and parallel with the cover 50.

The cavity filter 100 further comprises a driving device 30 and a tuning structure 40. The driving device 30 is received in the housing 10 and connects with the sliding plate 20 to drive the sliding plate 20 to move relative to the housing 10 and the cover 50. The tuning structure 40 is positioned on the cover 50 and passes through the cover 50 to engage with the sliding plate 20 and position the sliding plate 20 on a direction perpendicular to the cover 50.

Figure 3:
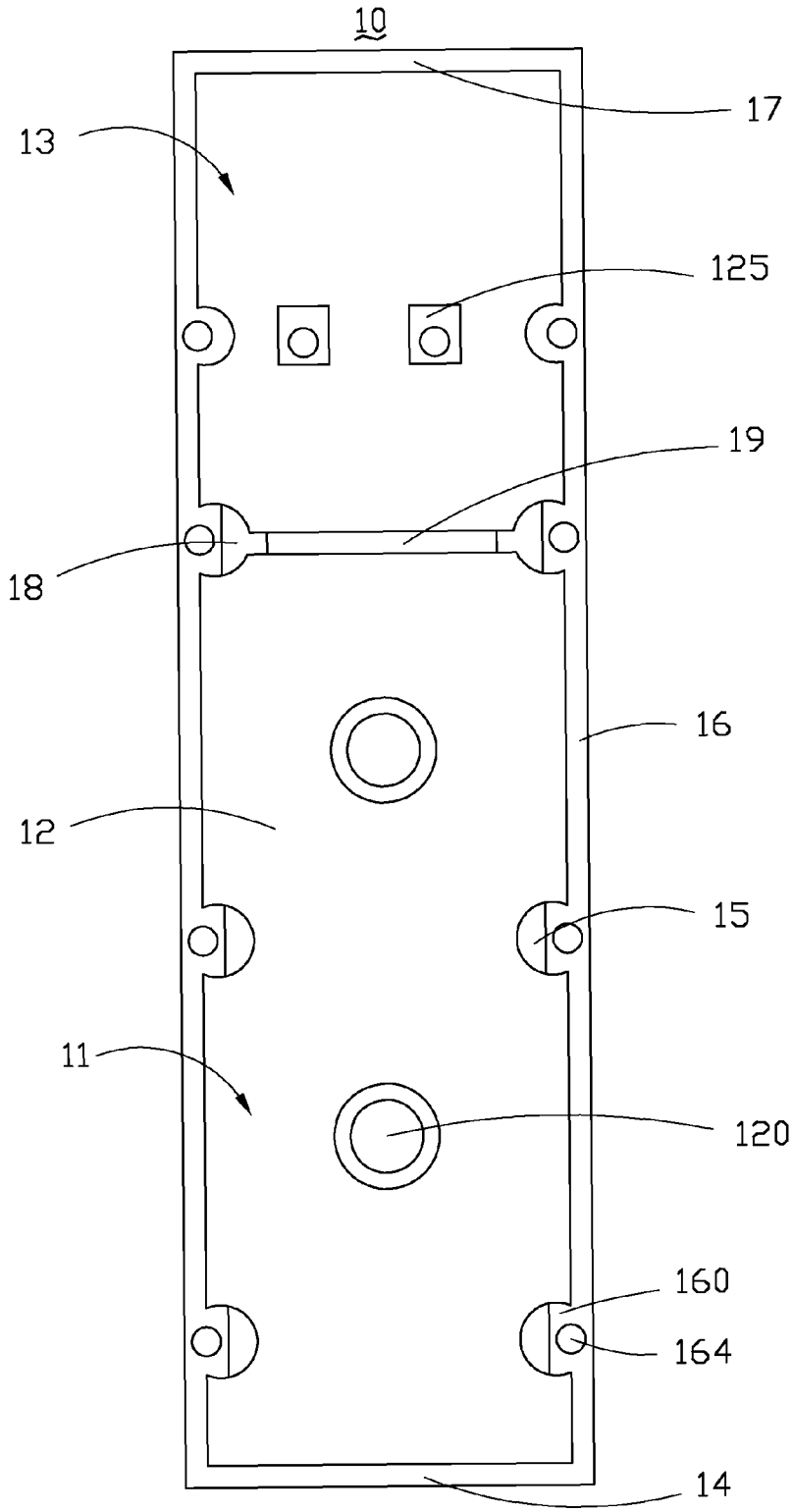
FIG. 3 is a perspective view of a housing of the cavity filter in accordance with the first exemplary embodiment of the disclosure.

Please referring to FIGS. 2 and 3, the housing 10 comprises a bottom portion 12, a first side wall 14, a pair of second side walls 16, a plurality of first positioning portions 15, a third side wall 17 parallel to the first side wall 14, a pair of second positioning portions 18, and a fourth side wall 19 parallel to the first side wall 14. The bottom portion 12 is substantially rectangular. The first side wall 14, the pair of second side walls 16, and the third side wall 17 perpendicularly extend from four edges of the bottom portion 12, respectively. The fourth side wall 19 perpendicularly extends from the bottom portion 12 and is perpendicularly configured between the pair of second side walls 16. The first side wall 14 and the third side wall 17 are configured between the pair of second side walls 16, and the fourth side wall 19 is configured between the first side wall 14 and the third side wall 17. Therefore, the bottom portion 12, the first side wall 14, the pair of second side walls 16, the third side wall 17, and the fourth side wall 19 collectively form a first cavity 11 and a second cavity 13 bordering upon the first cavity 11. The fourth side wall 19 is a common wall of the first cavity 11 and the second cavity 13.

Each of the pair of second side walls 16 comprises a plurality of fixing ribs 160 and defines a plurality of fixing holes 164 on the corresponding fixing ribs 160. Each of the plurality of fixing ribs 160 protrudes from the pair of second side walls 16 towards the first cavity 11 and the second cavity 13. Each of the plurality of first positioning portions 15 is depressed from the pair of second side walls 16 towards the first cavity 11, and has a first supporting surface 152 parallel with the cover 50. In the illustrated embodiment, each of the plurality of first positioning portion 15 is formed on a surface of the corresponding fixing rib 160 away from the corresponding fixing hole 164 towards the first cavity 11.

One pair of fixing ribs 160 is formed between the corresponding second side walls 16 and the fourth side wall 19, that is, the pair of fixing ribs 160 and the fourth side wall 19 cooperatively form the common wall between the first cavity 11 and the second cavity 13. The pair of second positioning portions 18 is respectively formed on top surfaces of the pair of fixing ribs 160 facing to the cover 50 and located between the corresponding fixing holes 164 and the fourth side wall 19. The pair of second positioning portions 18 and the plurality of first positioning portions 15 are used to support the sliding plate 20 together. Each of the pair of second positioning portions 18 has a second supporting surface 182 parallel with the cover 50. The second supporting surface 182 is configured on a same horizontal surface with the first supporting surface 152.

The housing 10 comprises a plurality of resonating tubes 120 and a plurality of fixing poles 125. Each of the plurality of resonating tubes 120 protrudes from the bottom portion 12 towards the first cavity 11 to engage with the sliding plate 20. Each of the plurality of fixing poles 125 protrudes from the bottom portion 12 towards the second cavity 13 to engage with the driving device 30.

The cover 50 tightly covers on the housing 10 to shield the first cavity 11 and the second cavity 13, and comprises a plurality of connecting members (not shown) and a plurality of tuning screws (not shown). The plurality of connecting members are fixed in the plurality of fixing holes 164 and the plurality of fixing poles 125 to securely mount the cover 50 on the housing 10. In the embodiment, each of the plurality of connecting members may be screws or positioning posts. The plurality of tuning screws respectively couple with the plurality of resonating tubes 120 to adjust a resonating frequency of the cavity filter 100.

The cover 50 defines a first locking hole 52 and a pair of first positioning holes 54. The first locking hole 52 and the pair of first positioning holes 54 are through holes. The pair of first positioning holes 54 is respectively defined on two opposite sides of the first locking hole 52 to engage with the tuning structure 40.

The sliding plate 20 movably covers on the first cavity 11 and connects to the driving device 30 which is securely fixed in the second cavity 13. The driving device 30 is used to drive the sliding plate 20 to move on the first supporting surfaces 152 and the second supporting surfaces 182 and to adjust the resonating frequency of the cavity filter 100. In the embodiment, the driving device 30 may be a motor or an air cylinder.

Figure 4:
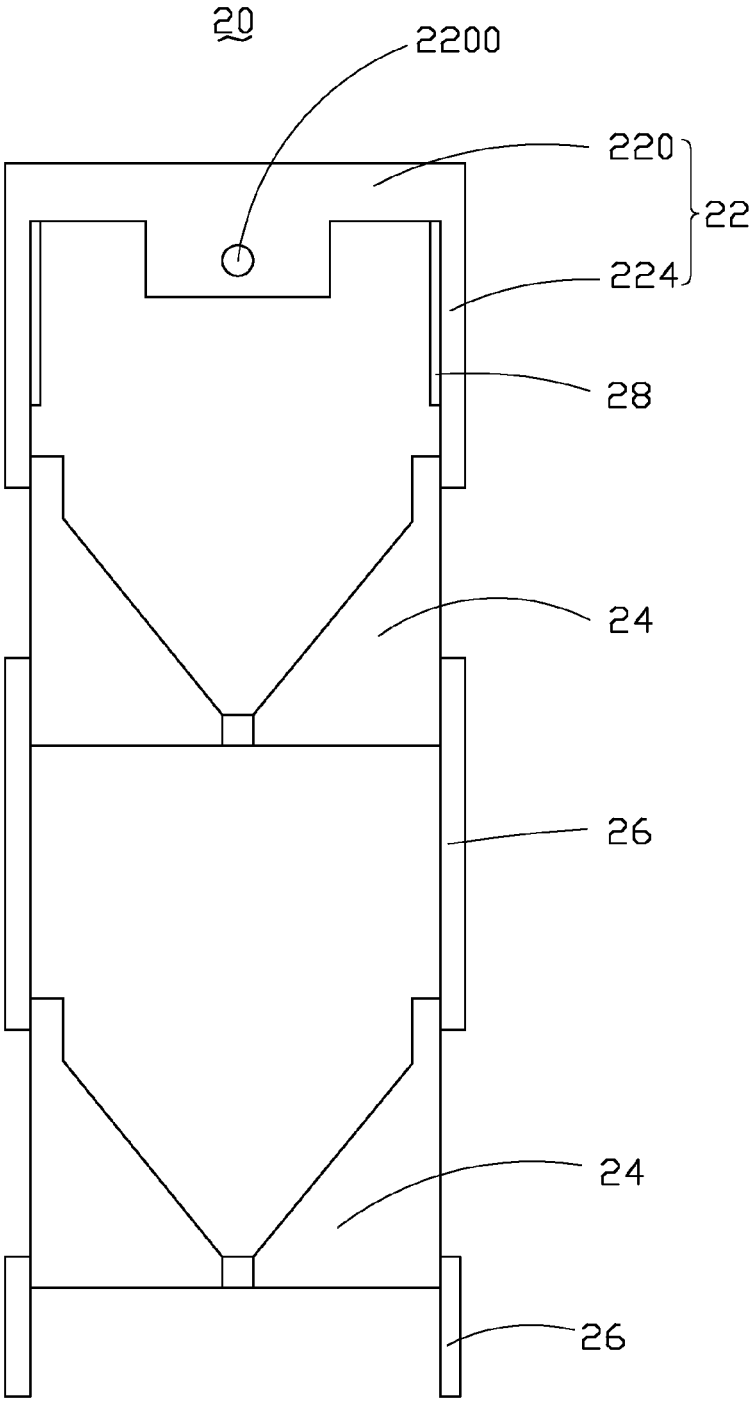
FIG. 4 is a perspective view of a sliding plate of the cavity filter in accordance with the first exemplary embodiment of the disclosure.

Please referring to FIG. 4, the sliding plate 20 comprises a connecting portion 22, a plurality of adjusting portions 24, a plurality of elastic arms 26, and a pair of resisting portions 28. The connecting portion 22 comprises a securing portion 220 and a pair of connecting arms 224 perpendicular extending from two ends of the securing portion 220. The securing portion 220 defines a connecting hole 2200. A fastener (not shown), such as a screw, passes through the connecting hole 2200 and is fastened on the driving device 30 to securely mount the sliding plate 20 onto the driving device 30. Each of the pair of the connecting arms 224 extends from the securing portion 220 to connect with the corresponding adjusting portions 24 and resists on the second supporting surface 182. In the illustrated embodiment, the securing portion 220 is integrally formed with the pair of connecting arms 224 and made of plastic material. Each of the plurality of adjusting portions 24 is plated with a metal layer, such as copper, and clustered with the elastic arm 26, that is, two ends of the elastic arm 26 respectively connect with two neighboring adjusting portions 24. In the illustrated embodiment, the number of the resonating tube 120 may be two, and the two resonating tubes 120 engage with two adjusting portions 24, respectively. In other embodiments, the number of the resonating tube 120 may be one, three, four, five or other numbers to match with the same number of the adjusting portions 24. The two adjusting portions 24 are connected with two pairs of elastic arms 26 one by one, that is, each pair of the elastic arms 26 are connected between the two neighboring adjusting portions 24. Each elastic arm 26 is made of insulated material, such as plastic, and resists on the corresponding first supporting surface 152. The pair of resisting portions 28 is securely fixed on the corresponding connecting arms 224 of the connecting portion 22 and collectively resist on the second supporting surfaces 182 with the corresponding connecting arms 224. In the illustrated embodiment, each of the pair of resisting portions 28 is made of insulated material, such as plastic.

Referring to FIG. 2 again, the tuning structure 40 comprises an elastic element 42, an adjusting screw 44 and a pressing part 46 engaging with the elastic element 42. The adjusting screw 44 is used to adjust a deformation degree of the elastic element 42 and to adjust a distance between the pressing part 46 and the sliding plate 20. In order to resist the elastic element 42 on the pressing part 46, the adjusting screw 44 passes through the elastic element 42 and is screwed into the housing 10.

Figure 5:
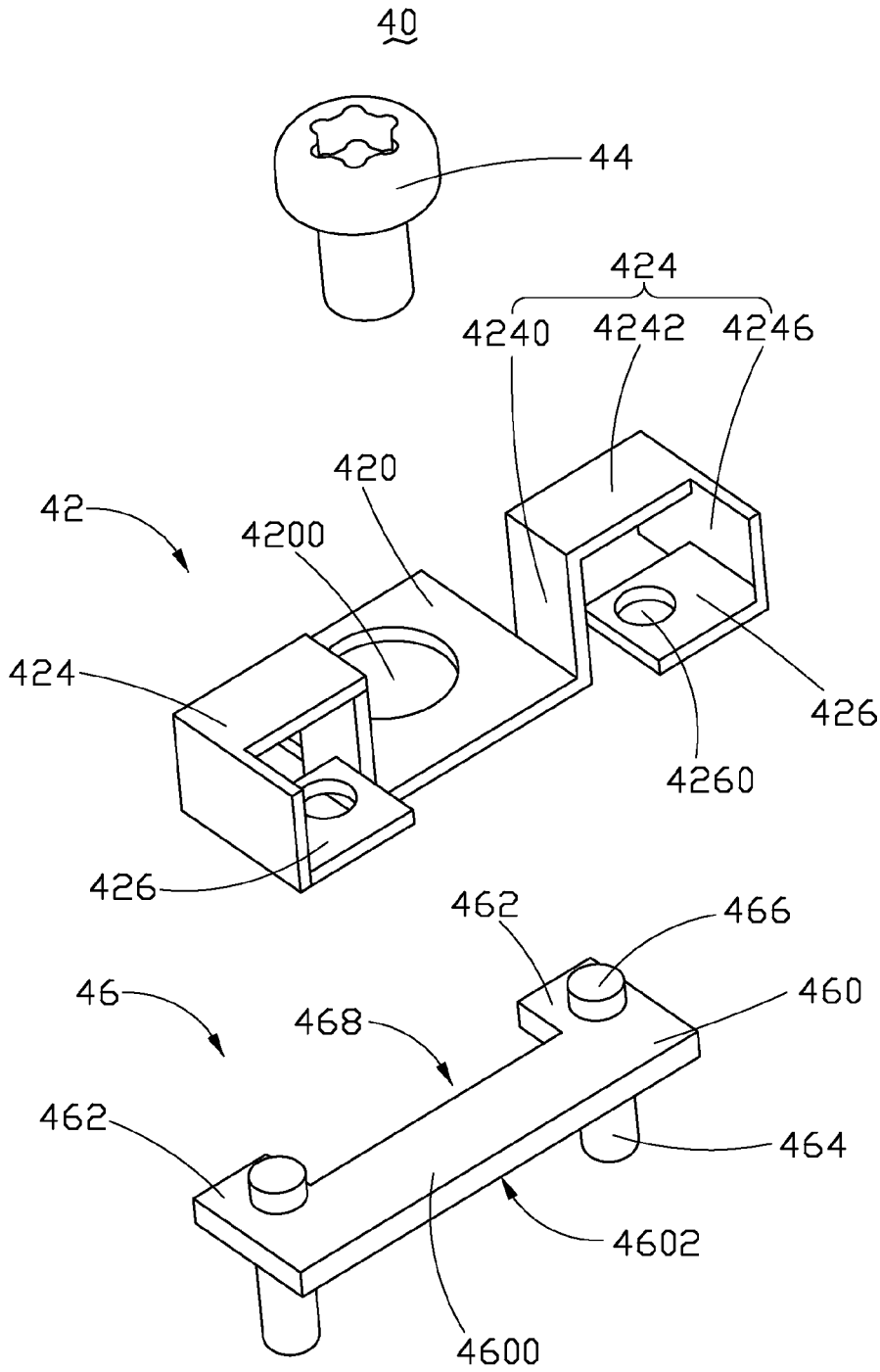
FIG. 5 is a disassembled perspective view of a tuning structure of the cavity filter in accordance with the first exemplary embodiment of the disclosure.
Figure 6:
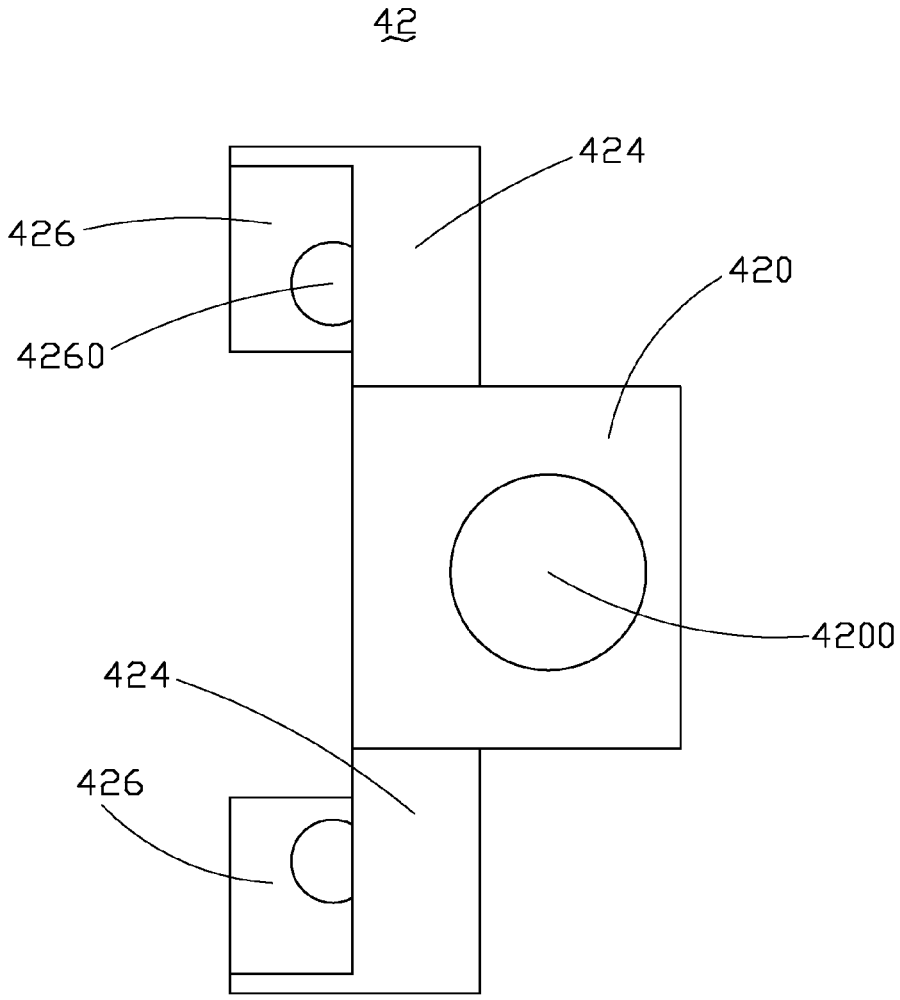
FIG. 6 is a schematic diagram of an elastic element of the tuning structure in accordance with the first exemplary embodiment of the disclosure.

FIG. 5 is a disassembled perspective view of the tuning structure 40 and FIG. 6 is a schematic diagram of the elastic element 42 in accordance with the first exemplary embodiment of the disclosure. The tuning structure 40 is used to engage with the cavity filter 100 with a single cavity (as shown in FIG. 3). The cavity filter 100 with the single cavity is defined as one housing 10 engaging with one sliding plate 20.

The elastic element 42 comprises a securing section 420, a pair of connecting sections 424 and a pair of pressing sections 426. The securing section 420 defines a second locking hole 4200. The adjusting screw 44 passes through the second locking hole 4200 and the first locking hole 52 of the cover 50, and is screwed into the fixing hole 164 of the housing 10 to adjust the deformation of the elastic element 42. The pair of connecting sections 424 is bent from two ends of the securing section 420, and configured between the securing section 420 and the corresponding pressing sections 426. Each of the pair of pressing sections 426 is bent from an end of the corresponding connecting section 424 away from securing section 420, and defines a second positioning hole 4260 to resist on the pressing part 46.

In the illustrated embodiment, each of the pair of connecting sections 424 comprises a first bending segment 4240, a second bending segment 4242 and a third bending segment 4246. The first bending segment 4240 perpendicularly extends from the securing section 420, the second bending segment 4242 perpendicularly extends from an end of the first bending segment 4240 away from the securing section 420 and is parallel with the securing section 420, and the third bending segment 4246 perpendicularly extends from an end of the second bending segment 4242 away from the first bending segment 4240 and is parallel with the first bending segment 4240. Each of the pair of pressing sections 426 perpendicularly extends from an end of the third bending segment 4246 away from the second bending segment 4242, and is parallel spaced apart between the securing section 420 and the second bending segment 4242.

In other embodiment, each of the pair of connecting sections 424 is bent between the securing section 420 and the pressing section 426.

In the illustrated embodiment, the securing section 420 and the pair of connecting sections 424 are integrally formed with the pair of pressing sections 426.

The pressing part 46 resists between the cover 50 and the elastic element 42, and controls a jumpiness of the sliding plate 20 between the housing 10 and the cover 50 by adjusting the adjusting screw 44. The pressing part 46 comprises a base portion 460, a pair of pressing portions 462, a pair of first positioning poles 464 and a pair of second positioning poles 466. The pair of pressing portions 462 perpendicularly extends from the base portion 460 and cooperatively form a recessed portion 468 with the base portion 460. The base portion 460 resists on an end of securing section 420 contiguous with the pressing section 426, and part of the securing section 420 is received in the recessed portion 468 to resist the pressing portions 462 on sides of the first bending segments 4240 of the connecting sections 424.

Each of the pair of first positioning poles 464 protrudes from the pressing portion 462 towards the cover 50, passes through the first positioning hole 54 of the cover 50 and extends into the first cavity 11 to close with the sliding plate 20 and to position the pressing part 46 onto the cover 50. Each of the pair of second positioning poles 466 protrudes from the pressing portion 462 towards the elastic element 42, and is received in the second positioning hole 4260 to position the elastic element 42 on the pressing part 46. In the illustrated embodiment, each of the pair of first positioning poles 464 is configured on a same line with the corresponding second positioning pole 466.

In the illustrated embodiment, the base portion 460, the pair of pressing portions 462, the pair of first positioning poles 464 and the pair of second positioning poles 466 are integrally formed.

Figure 7:
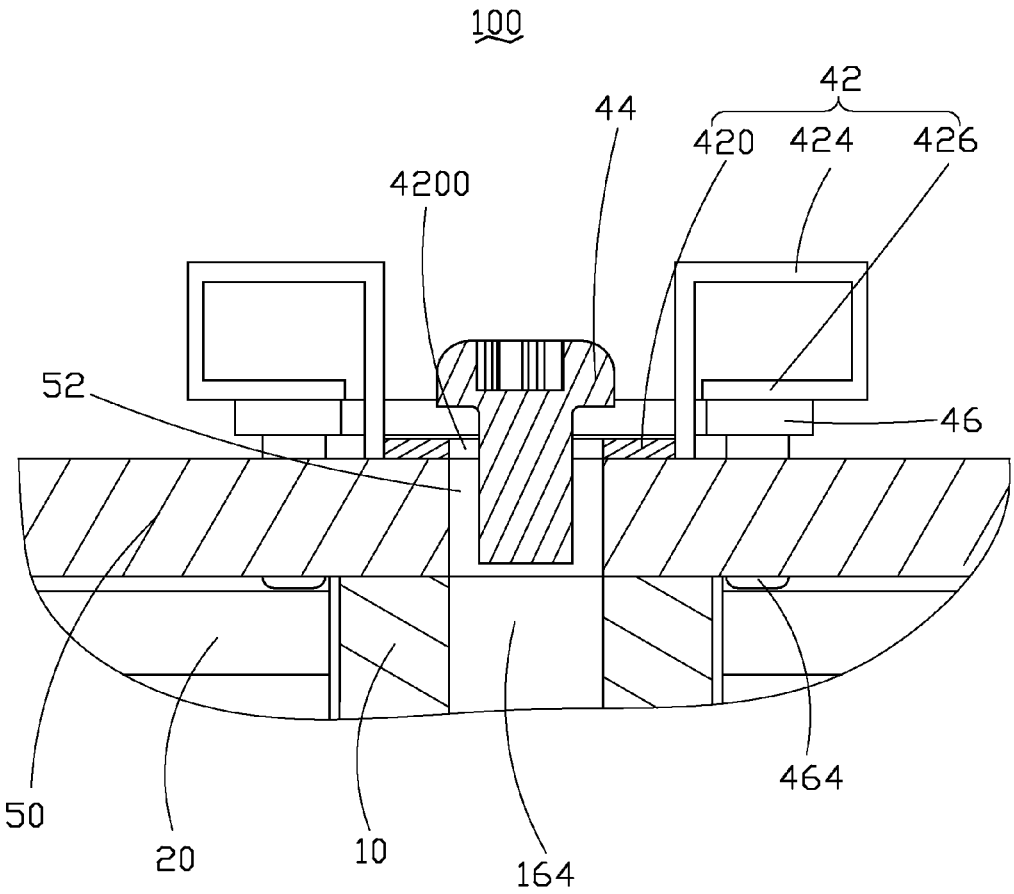
FIG. 7 is a cross-sectional view of the tuning structure in accordance with the first exemplary embodiment of the disclosure, showing a relative position between the tuning structure and the sliding plate.
Figure 8:
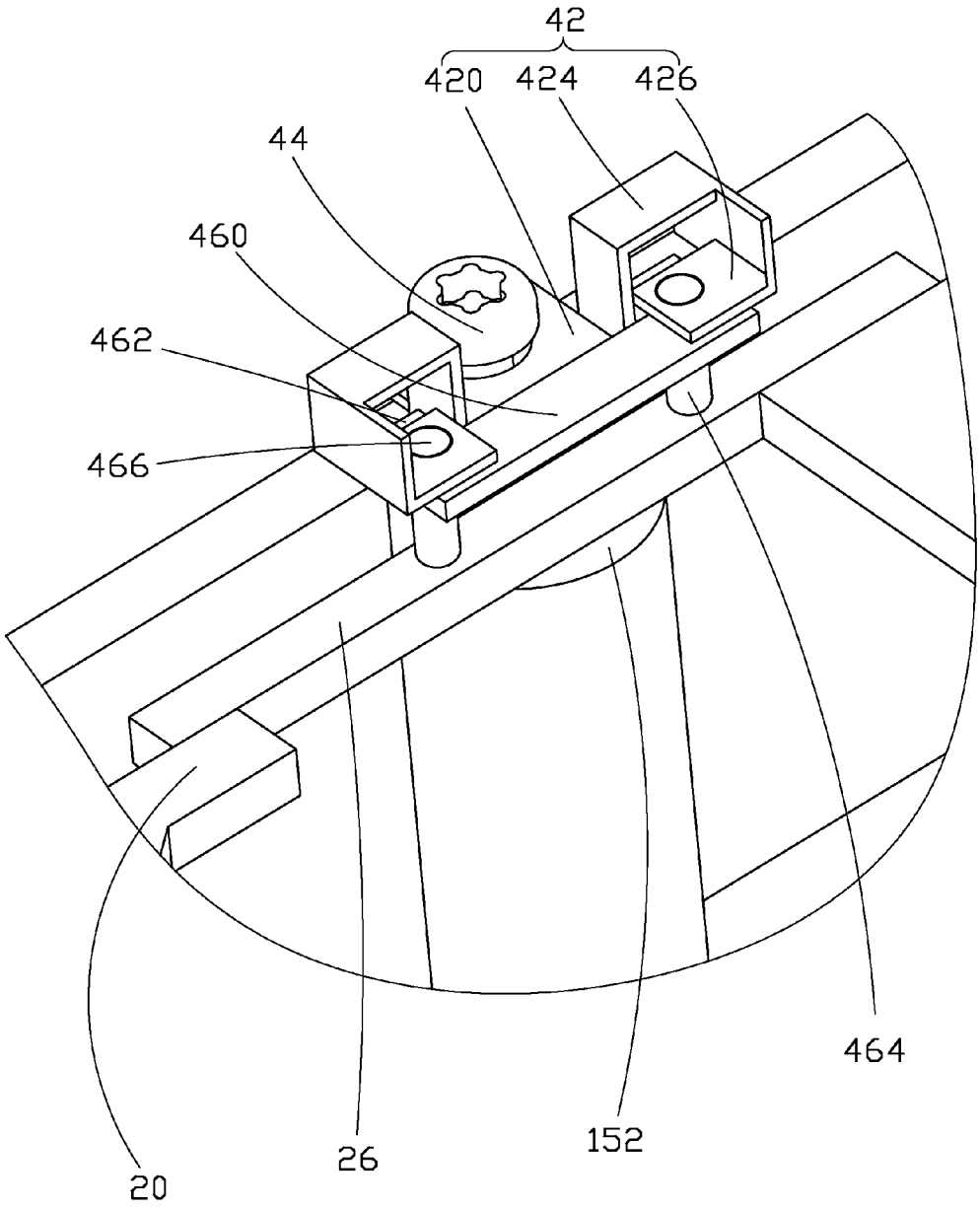
FIG. 8 is a perspective view of the tuning structure in accordance with the first exemplary embodiment of the disclosure, showing the tuning structure engaging with the housing and the sliding plate.

Please referring to FIG. 7 and FIG. 8, in assembly, the sliding plate 20 is received in the first cavity 11, the plurality of elastic arms 26 are supported on the first positioning portions 15 of the second side walls 16 and resist on the first supporting surfaces 152, and the pair of connecting arms 224 and the corresponding resisting portions 28 are set on the second positioning portions 18 of the second side walls 16 and cooperatively resist on the second supporting surface 182. The sliding plate 20 covers on the housing 10 with each of the plurality of adjusting portions 24 engaging with the resonating tube 120 of the housing 10, and with the connecting portion 22 mounting on the driving device 30. The plurality of elastic arms 26 are supported on the first supporting surfaces 152, and the cover 50 is fixed on the housing 10, so that the sliding plate 20 is mounted in the housing 10 to move on the first supporting surfaces 152 and close to the cover 50. The pair of first positioning poles 464 of the pressing part 46 extends through the first positioning holes 54 of the cover 50 and insert into the first cavity 11 to touch the corresponding elastic arms 26 of the sliding plate 20. The recessing portion 468 receives part of the securing section 420 to resist the pair of pressing portions 462 onto the pair of connecting sections 424, and the pair of second positioning poles 466 is received in the corresponding second positioning holes 4260 to position the elastic element 42 on the pressing part 46. The adjusting screw 44 passes through the second locking hole 4200 and is screwed into the first locking hole 52 to securely fix the elastic element 42 onto the cover 50.

In using, the driving device 30 drives the sliding plate 20 moving on the first supporting surfaces 152 and the second supporting surfaces 182 to tune the resonating frequency of the cavity filter 100. As the adjusting portions 24 is plated with a metal layer, a distributed capacitance between the cover 50 and the resonating tubes 120 is changed by adjusting a distance between the adjusting portions 24 and the resonating tubes 120, and the resonating frequency of the cavity filter 100 is adjusted.

When the sliding plate 20 is moving on the first supporting surfaces 152 and the second supporting surfaces 182, the pair of first positioning poles 464 resists on the elastic arms 26. A pressure of the pressing sections 426 resisting on the pressing part 46 can be adjusted by adjusting the adjusting screw 44 in the first locking hole 52 and the second locking hole 4200. Therefore, tightness between the pair of first positioning poles 464 and the sliding plate 20 is adjusted to prevent the sliding plate 20 jumping from the first supporting surfaces 152 and the second supporting surfaces 182. In the embodiment, it is easy to position the sliding plate 20 and to adjust the resonating frequency of the cavity filter 100.

The pair of first positioning poles 464 elastically resists on the elastic arm 26 to reduce a resistance between the sliding plate 20 and the cover 50 and to keep the sliding plate 20 smoothly moving on the housing 10. Each pair of the plurality of elastic arms 26 are symmetrically opposite to a geometric centre of the corresponding adjusting portion 24 to keep the resistance of two sides of the sliding plate 20 uniformly distributed and to prevent the sliding plate 20 slanting relative to the cover 50.

In other embodiment, two sliding plates 20 can be parallel connected to dispose on a signal sending cavity and a signal receiving cavity (not shown) of the cavity filter 100 and can be driven by only one driving device 30.

Figure 9:
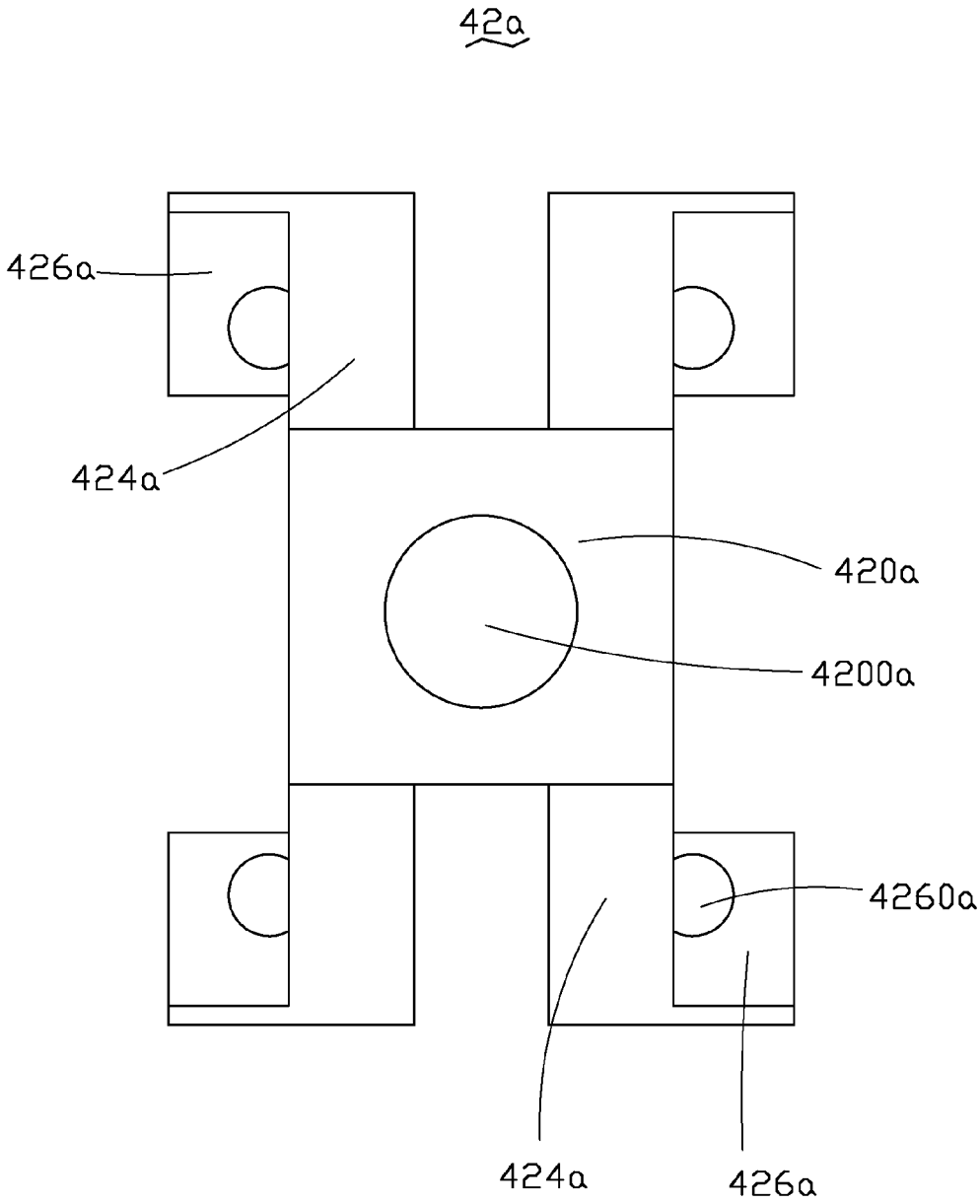
FIG. 9 is a schematic diagram of an elastic element of the tuning structure in accordance with a second exemplary embodiment of the disclosure.

FIG. 9 shows a schematic diagram of an elastic element 42*a* of the tuning structure 40 in accordance with a second exemplary embodiment of the disclosure. The differences between the elastic element 42 and the elastic element 42*a* are as follows. The elastic element 42*a* is used for a cavity filter (not shown) with double cavities, wherein the cavity filter with double cavities is defined as one housing (not shown) having a pair of cavities (not shown) and a pair of sliding plates (not shown) to cover on the corresponding cavities. The elastic element 42*a* comprises a securing section 420*a*, two pairs of connecting sections 424*a* and two pairs of pressing sections 426*a*. The securing section 420*a* defines a second locking hole 4200*a*. The adjusting screw 44 passes through the second locking hole 4200*a* and is screwed into the first locking hole 52 of the cover 50 to adjust the deformation of the elastic element 42*a*. The two pairs of connecting sections 424*a* are bent from ends of the securing section 420*a* in pairs, and configured between the securing section 420*a* and the corresponding pressing section 426*a*. Each of the two pairs of pressing sections 426*a* is bent from an end of the corresponding connecting section 424*a* away from securing section 420*a* to resist on the pressing part 46. Only one adjusting screw 44 is used to adjust the elastic element 42*a* and to control the sliding plate 20 moving in the double cavities.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A cavity filter, comprising:

a housing, comprising a positioning portion;

a cover, on top of the housing which have a pair of first positioning holes;

a sliding plate, with movably support on the positioning portion, mounted between the positioning portion and the cover, and configured to a resonating frequency of the cavity filter, the sliding plate comprising a plurality of elastic arms, the elastic arms made of insulated material and supported by the positioning portion; and a tuning structure, fixed on the cover and comprising a pair of first positioning poles, each of the pair of first positioning poles extending through the corresponding first positioning holes to touch the corresponding one of the plurality of elastic arms of the sliding plate.

2. The cavity filter of claim 1, wherein the housing comprises a bottom portion, a first side wall, a pair of second side wall, a third side wall, and a fourth side wall, the first side wall, the pair of second side walls, and the third side wall perpendicularly extend from four edges of the bottom portion, respectively, and the fourth side wall perpendicularly extends from the bottom portion and is perpendicularly configured between the pair of second side walls.

3. The cavity filter of claim 2, wherein the bottom portion, the first side wall, the pair of second side walls, the third side wall, and the fourth side wall collectively form a first cavity and a second cavity bordering upon the first cavity, and the fourth side wall is a common wall of the first cavity and the second cavity.

4. The cavity filter of claim 3, wherein the positioning portion comprises a plurality of first positioning portions and a pair of second positioning portions, each of the plurality of first positioning portions is formed on the pair of second side walls towards the first cavity, each of the pair of second positioning portions is formed on the pair of second side walls into the fourth side wall, the pair of second positioning portions and the plurality of first positioning portions are used to support the sliding plate together.

5. The cavity filter of claim 4, wherein each of the plurality of first positioning portions has a first supporting surface parallel with the cover, and each of the pair of second positioning portions has a second supporting surface on a same horizontal surface with the first supporting surface to support the sliding plate.

6. The cavity filter of claim 5, wherein the sliding plate comprises a plurality of adjusting portions plated with a metal layer, a securing portion and a pair of connecting arms perpendicular extending from two ends of the securing portion, one end of each of the pair of connecting arms connects to the corresponding adjusting portion.

7. The cavity filter of claim 6, wherein the securing portion is integrally formed with the pair of connecting arms and made of a plastic material.

8. The cavity filter of claim 6, wherein the cavity filter comprises a driving device received in the second cavity, and the driving device connects with the securing portion to drive the sliding plate to move on the plurality of first supporting surfaces and the pair of second supporting surfaces.

9. The cavity filter of claim 8, wherein the driving device is a selective one of a motor and an air cylinder.

10. The cavity filter of claim 6, wherein the sliding plate further comprises a pair of resisting portions securely fixed on the corresponding connecting arms, each of the pair of resisting portions and the corresponding connecting arm collectively resist on the second supporting surface.

11. The cavity filter of claim 10, wherein each of the pair of resisting portions is made of an insulated material.

12. The cavity filter of claim 1, wherein each two opposite elastic arms are in pairs to be connected between two adjusting portions, a number of the adjusting portion is equal to a number of the pairs of elastic arms, each pair of the plurality of elastic arms are symmetrically opposite to a geometric centre of the corresponding adjusting portion.

13. The cavity filter of claim 1, wherein the tuning structure comprises an elastic element, an adjusting screw, and a pressing part engaging with the elastic element, the pair of first positioning poles protrudes from the pressing part towards the cover to extend through the cover and to resist between the sliding plate and elastic arm, and the adjusting screw is used to fix the elastic element onto the cover to adjust a deformation of the elastic element.

14. The cavity filter of claim 13, wherein the elastic element comprises a securing section, a pair of connecting sections, and a pair of pressing sections, the adjusting screw passes through the securing section and the cover and is screwed into the housing, the pair of connecting sections is bent from two ends of the securing section and configured between the securing section and the corresponding pressing sections, and each of the pair of pressing section is bent from an end of the corresponding connecting section away from the securing section to resist on the pressing part.

15. The cavity filter of claim 14, wherein the cover defines a first locking hole, the housing defines a fixing hole to communicate with the first locking hole, the securing section defines a second locking hole, the adjusting screw passes through the second locking hole and the first locking hole and is screwed into the fixing hole to fix the turning structure onto the cover.

16. The cavity filter of claim 14, wherein the pressing part comprises a base portion, a pair of pressing portions and a pair of second positioning poles, the pair of pressing portions perpendicularly extends from the base portion, and each of the pair of second positioning poles protrudes from the pressing portion towards the elastic element, each of the pair of pressing portions defines a second positioning hole to receive the corresponding second positioning pole.

17. The cavity filter of claim 16, wherein each of the pair of first positioning pole and each of the pair of second positioning pole respectively protrude from two opposite surface of the pressing portion, and each of the pair of first positioning poles is configured on a same line with the corresponding second positioning pole.

18. The cavity filter of claim 16, wherein the pair of pressing portions cooperatively forms a recessed portion with the base portion, the recessed portion is used to partially receive the securing section.

19. The cavity filter of claim 16, wherein the base portion, the pair of pressing portions, the pair of first positioning poles and the pair of second positioning poles are integrally formed.

20. The cavity filter of claim 13, wherein the elastic element comprises a securing section, two pairs of connecting sections and two pairs of pressing sections, the adjusting screw passes through the securing section and is screwed into the cover, the two pairs of connecting sections are bent from ends of the securing section in pairs and configured between the securing section and the corresponding pressing section, each of the two pairs of pressing sections is bent from an end of the corresponding connecting section away from securing section to resist on the pressing part.

* * * * *